United States Patent [19]

Phillips

[11] Patent Number: 5,004,233

[45] Date of Patent: Apr. 2, 1991

[54] DEVICE FOR HOLDING CHALK FOR APPLICATION TO TIPS OF POOL CUES

[76] Inventor: Donnie C. Phillips, Rte. 1, Honea Path, S.C. 29654

[21] Appl. No.: 484,178

[22] Filed: Feb. 23, 1990

[51] Int. Cl.[5] ..... A63B 71/00

[52] U.S. Cl. ..... 273/21

[58] Field of Search ..... 273/17, 18, 19, 20, 273/21

[56] References Cited

U.S. PATENT DOCUMENTS

| | | | |
|---|---|---|---|
| 334,099 | 1/1886 | Zalhrenger . | |
| 789,779 | 5/1905 | Wright . | |
| 974,066 | 10/1910 | Jay . | |
| 1,016,953 | 2/1912 | Peloquin . | |
| 1,031,668 | 7/1912 | Vasbinder . | |
| 1,194,212 | 8/1916 | Moore | 273/21 |
| 1,254,564 | 1/1918 | Apostle | 273/20 |
| 1,334,724 | 3/1920 | Tayler | 273/20 |
| 1,450,741 | 4/1923 | Hill . | |
| 1,571,211 | 7/1925 | Nelson . | |
| 1,627,573 | 5/1927 | Peterson . | |
| 4,151,991 | 5/1979 | Smith, Jr. | 273/21 |
| 4,826,163 | 5/1989 | Ellul, Jr. | 273/21 |

FOREIGN PATENT DOCUMENTS

| | | | |
|---|---|---|---|
| 16778 | 7/1897 | United Kingdom | 273/21 |
| 163763 | 6/1921 | United Kingdom | 273/21 |
| 252866 | 6/1926 | United Kingdom | 273/21 |

*Primary Examiner*—Theatrice Brown

*Attorney, Agent, or Firm*—Dority & Manning

[57] ABSTRACT

An improved device for holding chalk for application to pool cue tips which includes a walled housing that defines a chalk receiving chamber therewithin for receipt of a plurality of cubes of chalk in side-by-side fashion. A front wall of the device has an opening that is adequate in dimension to permit ready access of the tip of a pool cue therethrough for contact with the appropriate surface of the chalk of any one of the cubes that is located behind the slot and within the housing. The chalk holding device according to the present invention is intended for mounting to a support surface such as a wall of a table, building wall or the like so as to preferably present the face of the chalk cubes to a player at an angular relationship in a range of from about 12° to about 45° to the vertical to facilitate ease of use. With a device according to the present invention a locking member is provided to hold the cubes of chalk within the intended area for same with the locking member adapted for receipt of a special tool for installation and removal to hamper and minimize chalk removal by players.

16 Claims, 2 Drawing Sheets

DEVICE FOR HOLDING CHALK FOR APPLICATION TO TIPS OF POOL CUES

BACKGROUND OF THE INVENTION

The present invention relates to an improved device for holding and presenting a plurality of pieces or cubes of cue chalk around a pool or billiard table for use by players in order to properly apply chalk to the tip of a pool cue.

Historically, chalk for application to the tip of a pool cue is presented in a solid cube form with a paper covering about at least a majority of all but one side of the cube and with the exposed cube side having a preformed concavity therein for receipt of the tip of a pool cue. Rotation of the pool cue with the tip in contact with the concave chalk imparts a thin coating of chalk onto the cue tip to enhance contact between the cue tip and a cue ball. The concavity is preformed into the cube of chalk form to ensure the proper application of chalk to the full surface of the cue tip from first use of the chalk until the chalk is totally consumed, with the concavity becoming deeper and deeper into the cubic body of the chalk with continued use.

Individual cubes of chalk have been normally placed about a pool or billiard table, simply resting on the table rail or some nearby surface such that a player desiring to chalk his cue can simply hold the chalk in one hand and the cue in the other hand, insert the tip of the cue into the concavity of the chalk and create relative rotational movement so as to apply the chalk to the tip of the cue. In instances where individual cubes of chalk are unattached and freely reside around the pool table, a number of potential problems and/or inconveniences exist. First, a player may inadvertently place the cube of chalk in his pocket during play, and after completion of play may walk away with the chalk thus necessitating the operator to supply a new cube of chalk. Secondly, since the chalk freely rests on the rail of the pool table, it can be knocked onto the table and interfere with play or knocked onto the floor where it may be stepped on and broken, thus destroying the chalk as well as marking up the floor, carpet, or other floor covering.

Also, many pool tables, particularly in commercial establishments include a ball return trackway leading from the various ball pockets to a central location at one end of the table to facilitate return of the balls for retrieval and/or reracking for a new game. Frequently individual cubes of chalk will be knocked from their resting place on the rail of the pool table into one of the six pockets around the table. While each of the trackways for returning the balls to a common location is provided with a space to permit the chalk to fall through the trackway, often the chalk becomes lodged in the trackway and interferes with return of the balls. When such an occurrence happens, it becomes necessary for the table operator or the owner of the establishment to gain access to the trackway and remove the chalk, thus permitting free return of the balls that were held by the chalk. Otherwise, play on the table will have to be suspended. Since many pool tables located in commercial establishments are serviced by amusement companies located away from the commercial establishment, an extra service call is routinely necessary which causes the operator to send a service man to the location for removal of chalk. Though the removal process is simple, obviously time is required for the operator to make the service call and until the chalk is removed, play on the table must be suspended thus interfering with the pleasure and amusement of the players as well as causing lost income to the owner of the establishment.

A number of attempts have previously been made to provide a holder for chalk which would alleviate or reduce at least certain of the problems noted above. Such prior efforts are exemplified in the prior art listed below.

Ellul, Jr., U.S. Pat. No. 4,826,163 provides an elongated tubular structure having circular openings at opposite ends of same. Cubes of chalk are located within the tubular structure and with the formed concavity of the chalk being exposed behind the circular end openings. The device is secured to a support surface with access to the chalk through opposite ends of the device.

The Smith, Jr., U.S. Pat. No. 4,151,992 patent presents a housing behind which two pieces of chalk are presented and with circular openings therethrough for access by the cue tip to the chalk. A key lock is located between the two openings for removal of the housing cover for replacement of expended chalk and the introduction of new cubes. A base plate to which the housing cover is affixed is secured to a support surface.

Peterson, U.S. Pat. No. 1,627,573 includes a tubular element for receipt of a cube of chalk behind a circular opening and with a spring bias behind the chalk to maintain same immediately adjacent the opening. The tube is angularly adjustable with respect to a mounting plate for securing same to a surface.

Nelson, U.S. Pat. No. 1,571,211 discloses a support structure for receiving two pieces of chalk exposed at opposite ends and with rotary means associated therewith for imparting rotation to the chalk for application of the chalk to a cue tip.

Hill, U.S. Pat. No. 1,450,741 discloses a circular container for receiving chalk behind a circular opening and with a special key for removal of the cover from the chalk.

Moore, U.S. Pat. No. 1,194,212 shows a device for receiving a single cube of chalk and for securing same beneath the rail of a pool table so as to protrude angularly outwardly therefrom. The cube of chalk is secured within its housing with the end of same having the formed concavity being totally exposed for receipt of a cue tip.

Vasbinder, U.S. Pat. No. 1,031,668 is directed to an automatic chalking device where a cube of chalk held within a housing is automatically rotated by a spring mechanism for application of chalk to the cue.

Peloquin, U.S. Pat. No. 1,016,953 shows a chalk holder for mounting beneath the side rails of a pool table and for presenting a single cube of chalk behind a circular opening.

Jay, U.S. Pat. No. 974,066 shows a covered housing for receipt of a single cube of chalk and with a spring ratchet arrangement coupled with a spiral shaft for imparting rotation to the chalk for automatic chalking.

Wright, U.S. Pat. No. 789,779 shows a rectangular housing for receiving chalk therein and with openings at the ends of the housing exposing chalk to a cue tip. A special lock is provided to prevent removal of the chalk from the housing except by one with authority to do so.

Zaehringer, U.S. Pat. No. 334,099 discloses a housing for a cube of chalk which is located behind a circular opening with a housing that is mountable beneath a pool table.

While each of the above prior art patents discloses some technique for holding a piece of cue chalk and presenting same to a player for application of the chalk to the tip of a pool cue, such patents do not anticipate or suggest the structure of the improved device according to the present invention.

SUMMARY OF THE INVENTION

It is an object of the present invention to provide an improved device for holding pool cue chalk.

Another object of the present invention is to provide an improved device for holding pool cue chalk in a side-by-side relationship in which a plurality of cubes of chalk may be presented for use by a player.

Still another object of the present invention is to provide an improved device for holding pool cue chalk and for securing same against removal from the holder except by authorized personnel.

Yet another object of the present invention is to provide an improved device for holding pool cue chalk in an out of the way location such that a player will have access to the chalk for applying same to the tip of a pool cue while avoiding contact with the chalk, and without the chalk getting in the way of play.

Generally speaking, the present invention relates to an improved device for holding pool cue chalk comprising a housing, the housing having a plurality of walls, one of the walls defining an opening therealong adequate in size to permit ready passage of a tip of a pool cue therethrough at different locations along the length of same, the housing defining an area within the walls for receipt of a plurality of cubes of cue chalk therein and with chalk of each cube being exposed behind the opening for contact with a cue tip passing through the opening, means for locking the chalk cubes within the housing against removal on location, and means for mounting the device on a surface to present the chalk for application of the chalk to a cue tip.

Still further an improved device according to the present invention preferably includes a housing with one or both ends of the housing open for the receipt of a plurality of cubes of cue chalk in side-by-side relation therein and with one wall of the housing having a slotted opening along at least a majority of the length of the wall, and most preferably substantially the entire if not all the length of the wall. The wall slot is adequate in size to freely permit a cue tip to pass therethrough into contact with any one of the chalk cubes located in the housing. A locking means is applied at the open end or ends of the housing so as to secure the cubes of chalk within the housing and with the locking means preferably being adapted to receive a tool of a predetermined design only for unlocking, such that players would have difficulty in removing the chalk from the housing.

Since the devices are to be secured in place for use by a player, in order to accommodate the players, the device is mounted such that the chalk within the housing is presented at an angular relationship conducive for ease of chalking. Preferably, the chalk is presented at an upward angle with respect to vertical in a range of from about 12° to about 45° and most preferably in a range of from about 17° to about 30°, with a most preferred angle being 22°. Chalk so presented may then be conveniently and easily accessed by a player for applying chalk to the tip of the cue. Further, since the housings are to be mounted on a support surface, preferably a vertical wall beneath the rail of the pool table, all exposed corners should be rounded to lessen injury to a player or damage to clothing worn by the player.

BRIEF DESCRIPTION OF THE DRAWINGS

The construction designed to carrY out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENTS

Referring to the Figures, preferred embodiments of the present invention will now be described in detail.

Figure 1:
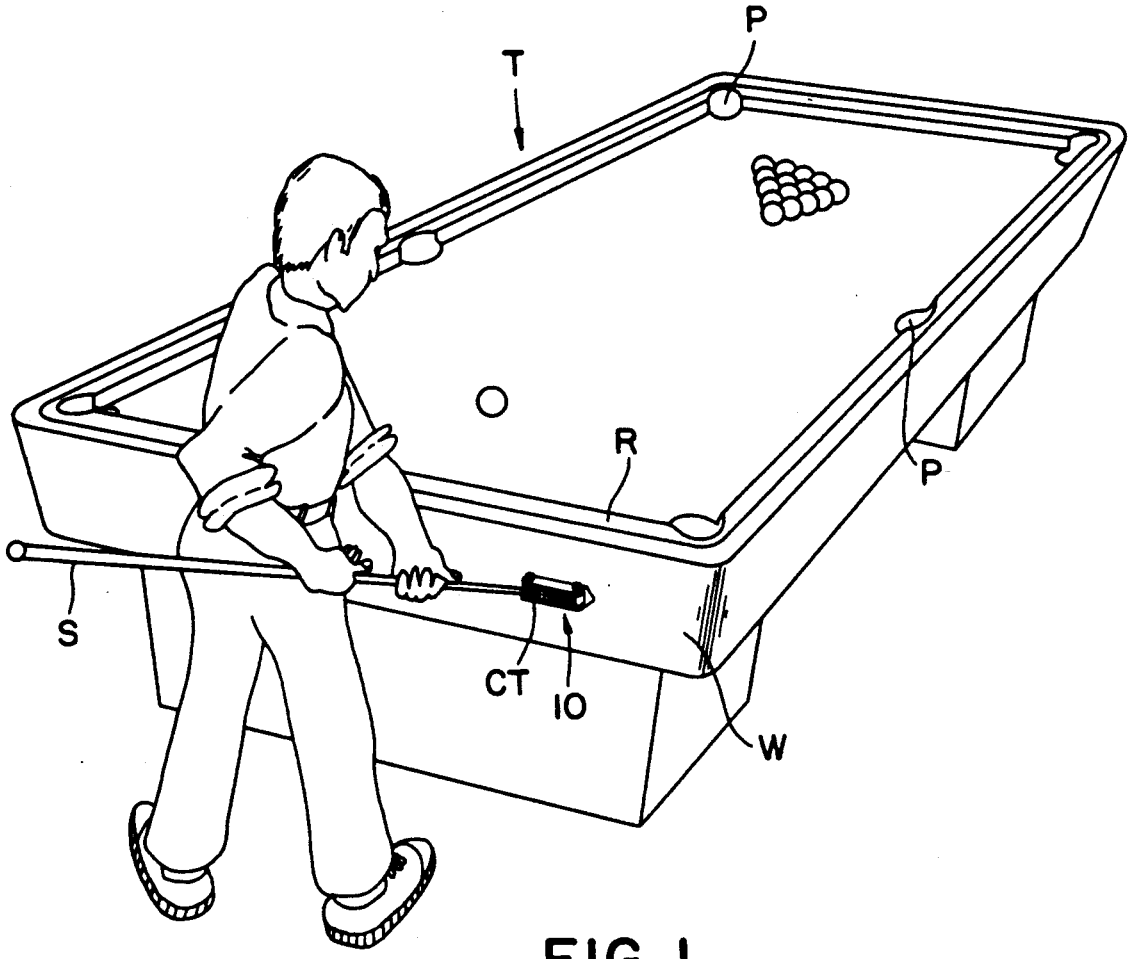
FIG. 1 is an illustrative view of a pool table having a device according to the present invention mounted thereon showing a player chalking a cue.

FIG. 1 illustrates a general environment in which a device according to the present invention is intended to be employed. In FIG. 1, a pool table generally T is illustrated having a plurality of pockets P located therearound in conventional fashion, and with rails R surrounding the perimeter of the table T located above a frame wall W of the table. A player is shown standing at an end of table T holding a cue stick S with the tip CT of cue stick S being chalked by placement into contact with a cube of chalk held within a device generally 10 according to the present invention as will be explained in detail hereinafter. With the device 10 so located at opposite ends of the table T for example, convenient use by all players would be provided, though additional devices 10 could also be installed on the side walls of the table as well as surrounding building walls, cue stick holders, cabinets or the like.

Insofar as the present invention is concerned, and as noted above, the location of the chalk in such a device moves the chalk from atop the rails R of table T and holds them in place, whereby the chalk will not fall through the pockets and into the trackways (not shown) within table T to create an impediment to return of the balls along the trackway. Moreover, by placement of the cue chalk in a device 10 according to the present invention, the chalk is not lost, carried away by a player, does not fall onto the floor to be kicked under the table or stepped on by a player and, is always available in adequate supply for play.

Figure 2:
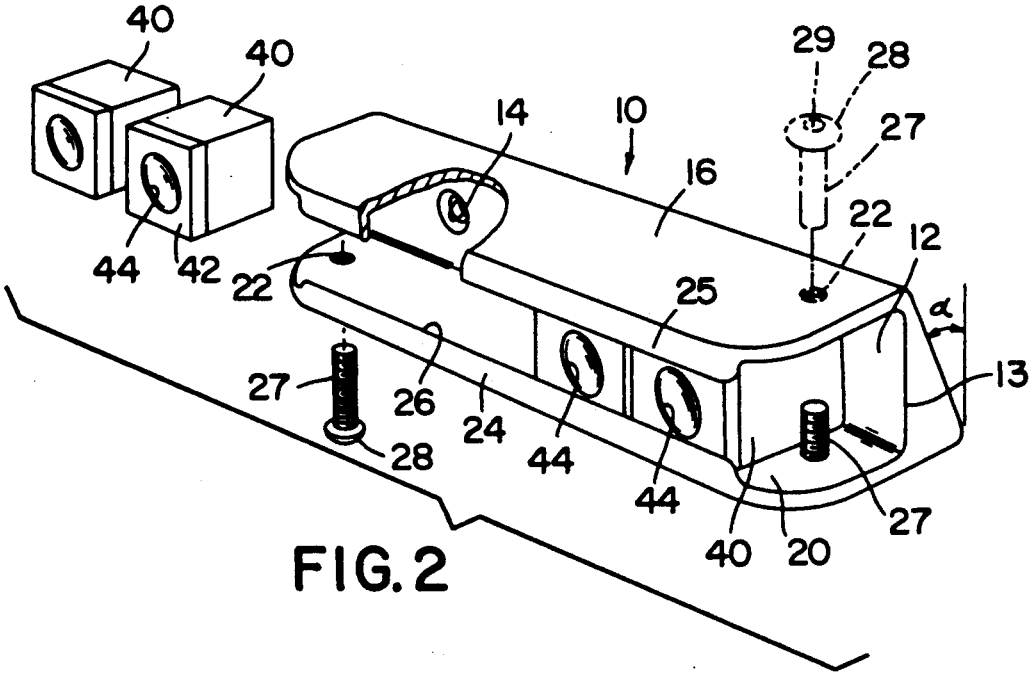
FIG. 2 is an isometric view of an improved chalk holding device according to the present invention, with a partial cut-away to disclose a feature of same.

A most preferred embodiment according to the present invention is illustrated in FIG. 2 generally as 10. Device 10 includes a housing made up of a rear wall 12, a top wall 16, a bottom wall 20, and a front wall defined by sections 24 and 25 depending from bottom wall 20 and top wall 16 respectively, and which cooperate to define a slot 26 therebetween. As can be seen, the various walls of device 10 cooperate to define a chamber or area for receipt of a plurality of cubes of chalk 40 in side-by-side disposition with the face 42 of chalk 40 exposed behind slot 26 such that the tip of a pool cue may easily be inserted into the formed concavity 44 of any of the chalk cubes 40 located within device 10. As illustrated in FIG. 2, front wall sections 24 and 25 are basically flanges secured to bottom and top wall sections 20 and 16, respectively, which depend in a generally transverse direction therefrom. Front wall sections 24 and 25 thus extend towards each other. Slot 26, which is defined by front wall sections 24 and 25 as can be seen with the chalks 40 located therebehind is adequate in size to permit ease of insertion of the tip of a pool cue therethrough into contact with the face of a chalk cube 40 for application of chalk to the tip of the cue.

Also as noted in FIG. 2, the chalk chamber defined by the walls of device 10 is open at both ends with bottom and/or top walls 16, 20 having a threaded opening 22 therethrough for receipt of a threaded locking means 27. Threaded locking means 27 has a rounded head 28 with an opening 29 located in an upper end of same and is adapted for receipt of a special shaped tool for installation and removal. In fact, it is intended that locking members 27 when inserted at an end of the chalk chamber be positioned in the way of the chalk cubes such that once installed, the chalk cannot be removed from the chamber. Hence, the rounded head 28 and opening 29 of a particular design are intended to impede removal of locking member 24 by a player. By way of example, opening 26 in rounded top section 25 of locking member 24 may have a polygonal shape so as to receive an allen wrench or the like, though if desired a less universal shape or design may be employed to further limit the ease with which one can remove locking member 27 from device 10 without a proper matching tool.

Impedence to removal of chalk cubes 40 from a device 10, as noted above, always ensures the availability of chalk at the installation site of device 10, avoids breaking of chalk by a player stepping on same, avoids theft or inadvertent removal of the chalk from the premises, and last but not least, avoids the possibility of the chalk falling into the ball return trackway which can render the table inoperative.

Since device 10 is to be mounted at an accessible location, preferably somewhere around the perimeter of a pool table, it is likely to be contacted by a player or by garments worn by a player. Consequently, in a most preferred arrangement, all exposed corners are rounded to reduce, if not alleviate, bruising of a player's leg, tearing s player's pants or the like. In fact, in a preferred structure as illustrated in FIG. 2, device 10 may be of extruded aluminum or other metal which, after extrusion, is cut and machined to a very smooth, polished state at the outer extremeties of top and bottom walls 16 and 20, for example, to at least minimize the chance for such damage.

Chalk holding device 10 according to the present invention, is intended to be secured to a side wall W of a pool table T or some surrounding structure so as to conveniently permit access of the pool cue tip thereto. Chalk holding devices according to the present invention are thus intended to be mounted to present chalk 40 received therein preferably at an angular relationship with respect to vertical. As shown in FIG. 2, a rear outer surface 13 of rear wall 12 is tapered such that an angle $\alpha$ with respect to vertical is achieved somewhere in a range of from about 12 to about 45°. Furthermore, rear wall 12 has a plurality of fastening member receiving openings 14 located therein (only one shown) which will receive conventional fastening members for securing device 10 to a wall W of a pool table T or other suitable support surface. When device 10 is so mounted, angular rear wall surface 13 is flush with the wall W or the like and with the fastening members securing same thereto, chalk 40 in device 10 will be presented at an angle $\alpha$ with respect to vertical somewhere in the range of about 12° to about 45°. Such angle best presents the formed depression 44 in the face 42 of chalk 40 to a player for insertion of the tip CT of a cue stick S therein and rotation to cause a thin layer of chalk to be applied to tip CT. In a more preferred situation, the range of angle $\alpha$ for presentation of the face of the chalk is from about 17° to about 30°, and most preferably about 20°.

Figure 3:
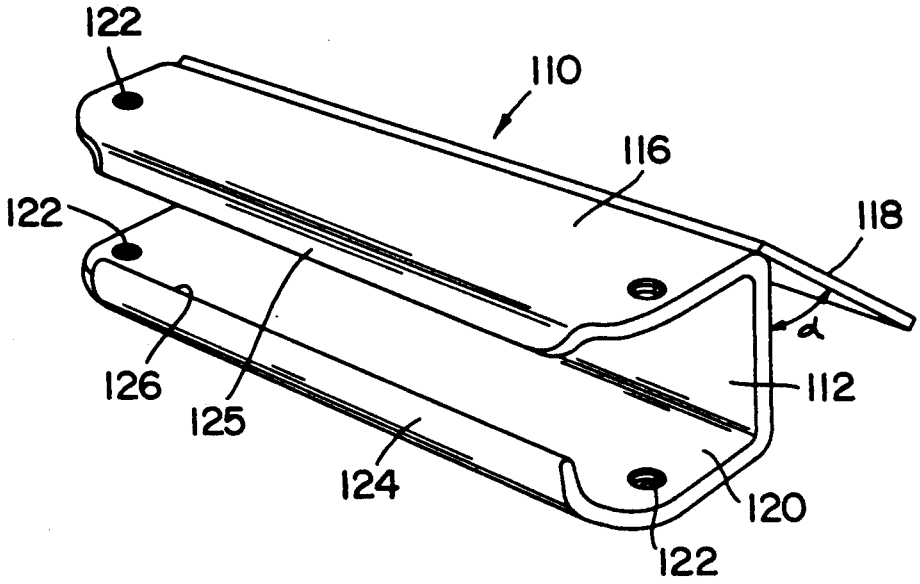
FIG. 3 is an isometric view of a further embodiment of a device according to the present invention.

FIG. 3 illustrates a further embodiment of a chalk holding device generally 110 according to the present invention which is made up of a rear wall 112, a top wall 116, a bottom wall 120 and front wall sections 124 and 125 which cooperate to define a slot 126 therebetween, and totally along the length of same. Such defines a housing as shown in FIG. 2 for receipt of a plurality of cubes of chalk in side-by-side fashion to expose the formed concavity 44 of each chalk 40 behind slot 126 for easy access of a pool cue tip CS thereto. Differently from FIG. 2, the embodiment of FIG. 3 shows that rear wall 112 has parallel inside and outside surfaces and that a further mounting element or flange 118 is secured to device 110 at an angular relationship to define an angle $\alpha$, again in a range of from about 12° to about 45° to vertical. Mounting member 118 further has at least one fastening member receiving opening (not shown) therein for receipt of conventional fastening members for the securement of device 110 to an intended support surface. When so mounted, the chalk will be presented at an angle $\alpha$ in a range of from about 12° to about 45°, more preferably 17° to 30°, and most preferably about 20° for ease of access to a player.

Figure 4:
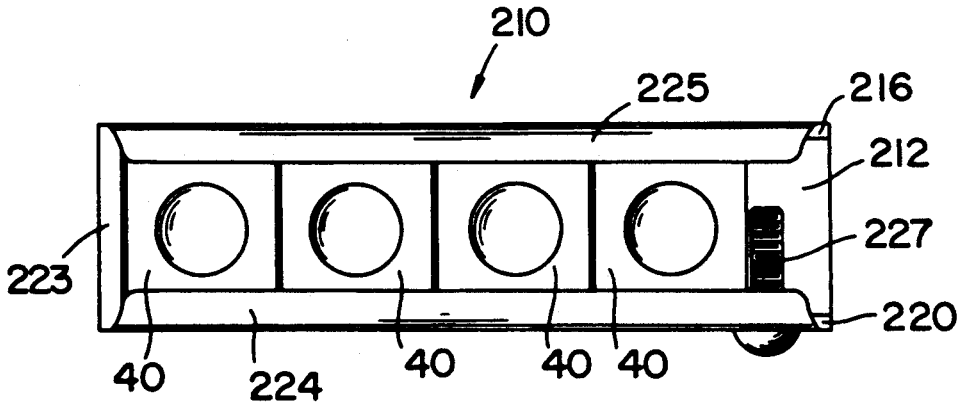
FIG. 4 is a frontal view of yet a further embodiment according to teachings of the present invention.

FIG. 4 illustrates yet a further embodiment of a chalk holding device 210 according to the present invention which, in addition to a rear wall 212, a top wall 216, a bottom wall 220, and front wall sections 224, and 225 includes an end wall section 233 which closes the left hand end of the chalk receiving chamber as visualized. A locking member 227 of the type as shown in FIG. 2 is presented at a right hand end of the chalk receiving chamber as viewed in FIG. 4 to lock the chalk in place in like fashion as described hereinbefore.

While preferred embodiments of the present invention have been described in detail above, it should be understood that the devices may be manufactured of metal that is bent or otherwise deformed to assume the shapes of the various walls, that the device may be extruded from metal, may be molded of polymeric materials by injection molding or other techniques, and the like. In like fashion, obviously it is not necessary that the various elements be of unitary construction as shown, but instead the individual wall sections may be welded or otherwise secured to each other so as to define the overall device. Moreover, while certain embodiments have been illustrated with respect to certain figures, the embodiment of any one figure may be substituted and/or otherwise incorporated into any of the embodiments shown herein. Moreover, while locking means receiving openings are shown in both top and bottom walls of the devices of FIGS. 2 and 3, such openings in both walls are not necessary, but are shown to afford an option to an operator depending upon the intended use of same.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein disclosed.

What is claimed is:

1. An improved device for holding chalk for application to pool cues comprising an elongated housing, said housing having a plurality of spaced apart walls, one of said walls defining an elongated opening therealong, said opening extending substantially the length of said housing and being adequate in size to permit passage of a tip of a pool cue therethrough along the length of same, said housing defining a chamber within said walls for receipt of a plurality of cubes of cue chalk therein, each said cube being exposed behind said opening for contact with a cue tip passing therethrough, said chamber extending at least a major portion of the length of said housing, means for locking said chalk cubes within said housing against removal, and means for mounting said device on a surface to present said chalk behind said opening for application of said chalk to a cue stick.

2. A device as defined in claim 1 wherein the housing is of unitary construction and has two opposite open ends and wherein said means for locking said chalk within said housing are located at each of said open ends of said housing.

3. A device as defined in claim 2 wherein said device includes a rear wall of said housing, said rear wall having an outer tapered surface and fastening means for securing said rear wall of said housing to said surface.

4. A device as defined in claim 1 wherein said housing includes a rear wall, a top wall, a bottom wall and a front wall, said opening being defined in said front wall.

5. A device as defined in claim 4 wherein said rear wall has a tapered outer surface and defines at least one fastening member receiving opening therethrough.

6. A device as defined in claim 5 wherein said chamber defined by said housing is open at opposite ends of same, and wherein said locking means comprise at least one rod member in threaded engagement with one of said walls at opposite ends of said area and extending towards another of said walls, said rod member being adapted for removal.

7. A device as defined in claim 4 wherein said housing further includes one end wall, said end wall closing one end of said chalk receiving area.

8. A device as defined in claim 1 wherein said means for mounting said device includes a flange secured to said housing and extending angularly outwardly therefrom, said flange defining at least one fastening member receiving opening therein whereby said device may be secured to a surface to present chalk held by said device at a particular angle for receipt of a cue tip.

9. An improved device for holding chalk for application to a cue tip comprising an elongated housing, said housing including a rear wall, a top wall, and a bottom wall, said top and bottom walls including an inner end and an outer end, said inner ends being attached to said rear wall, said top and bottom walls having an inturned flange at said outer end thereof, said flanges extending toward each other and defining a slot therebetween, said slot extending substantially the entire length of said housing and being adequate in size to permit passage of a pool cue tip therethrough, said walls defining a chamber therebetween for receipt of a plurality of pieces of cue chalk in side-by-side relationship, locking means on said housing for securing said pieces of chalk within said chamber, said locking means being adapted for receipt of an unlocking means of a predetermined shape said housing further having means for mounting said device to a support surface to present said chalk in said chamber and behind a slot at a predetermined angle for receipt of a tip of pool cue.

10. A device as defined in claim 9 wherein said housing is of unitary construction.

11. A device as defined in claim 10 wherein said rear wall has a tapered outer surface and defines a plurality of fastening number receiving openings for mounting said device at the angular relationship to a support surface.

12. A device as defined in claim 11 wherein said outer surface of said rear wall tapers at an angle measured from vertical of from about 12 to about 45 degrees.

13. A device as defined in claim 12, wherein said housing further includes a wall for closing one end of said chamber, and said locking means are located at the opposite end of said chamber, said locking means comprising an elongated rod threadably connected to one of said housing walls, said rod defining a receiving portion at one end adapted to receive an unlocking tool of a predetermined shape.

14. A device as defined in claim 12, wherein exposed outer corners of said top and bottom walls are rounded.

15. A device as defined in claim 9 wherein said means for mounting is a mounting plate secured to said housing and extending outwardly therefrom, said plate being oriented such that when secured to a support surface, said chalk is presented at a predetermined angle with respect thereto.

16. A device as defined in claim 15 wherein said angle is in a range of from about 12 to about 45 degrees when measured from vertical.

* * * * *